United States Patent [19]

Karakama et al.

[11] Patent Number: 5,040,565

[45] Date of Patent: Aug. 20, 1991

[54] PILOT OPERATED CONTROL VALVE SYSTEM

[75] Inventors: Tadao Karakama; Naoki Ishizaki; Yosuke Oda, all of Kanagawa, Japan

[73] Assignee: Kabushiki Kaisha/Komatsu Seisakusho, Tokyo, Japan

[21] Appl. No.: 425,174

[22] PCT Filed: Feb. 28, 1989

[86] PCT No.: PCT/JP89/00205

§ 371 Date: Oct. 17, 1989

§ 102(e) Date: Oct. 17, 1989

[87] PCT Pub. No.: WO89/08198

PCT Pub. Date: Sep. 8, 1989

[30] Foreign Application Priority Data

Feb. 29, 1988 [JP] Japan ..... 63-44104

[51] Int. Cl.[5] ..... F15B 13/043

[52] U.S. Cl. ..... 137/596.15; 91/454; 137/596.16; 137/884

[58] Field of Search ..... 91/454; 137/596.14, 137/596.15, 596.16, 884

[56] References Cited

U.S. PATENT DOCUMENTS 2,984,257 5/1961 McCormick ..... 91/454 X
3,556,144 1/1971 Bickers et al. ..... 137/596.15
4,711,267 12/1987 Schwelm ..... 137/596.15

FOREIGN PATENT DOCUMENTS 60-43701 3/1985 Japan .
62-13802 1/1987 Japan .
62-13803 1/1987 Japan .

*Primary Examiner*—Gerald A. Michalsky
*Attorney, Agent, or Firm*—Ronald P. Kananen

[57] ABSTRACT

In a pilot operated control valve system provided with a plurality of valves for controlling hydraulic equipment such as hydraulic cylinders, there are employed a plurality of valves each of which does not interfere with each other in operation and requires a minimum mounting space in said system to enable said system to be a small-sized system having a construction easily adapted to control a plurality of hydraulic equipments. The control valve system comprises: a valve (10) assuming a rectangular parallelepiped form; a first (11) and a second (12) pump port passage so formed in an upper portion of a valve housing of said valve (10) as to horizontally and parallelly extend to each other and as to communicate with a hydraulic pump; a tank port passage (13) formed in a lower central portion of said valve housing; a pilot tank port passage (25) so formed ina central portion of the valve housing as to communicate with a drain tank; a first (14) and a second (15) port passage vertically formed in said valve housing so as to separately open into an upper surface of said valve housing to communicate with each of pressure chambers of said hydraulic equipment; a plurality of valves (19, 20, 23, 24) inserted into a plurality of valve receiving bores formed in said valve housing so as to shud off desired ones of these port passages from said remaining port passages; and pilot valves for supplying the pilot pressure oil to these valves.

4 Claims, 10 Drawing Sheets

III
V
10
10a
10b
10c
10d
11
12
13
14
15
16
16₁
16₂
17
18
19
20
21
22
23
24
25
26
27
31
35

PILOT OPERATED CONTROL VALVE SYSTEM

FIELD OF THE INVENTION

The present invention relates to a control valve system for supplying a pressure oil to hydraulic equipment such as hydraulic cylinders, hydraulic motors and the like to control that hydraulic equipment in operation, and more particularly to a pilot operated control valve system for conducting directional controls of a plurality of valves of the system by means of pilot pressure oil.

DESCRIPTION OF THE PRIOR ART

Hitherto, it is known that, for example as shown in FIG. 1, in a control valve system of this kind that a pressure oil discharged from a hydraulic pump 1 is supplied to a first chamber $3_1$ and a second chamber $3_2$ of a hydraulic device 3 through a first meter-in valve $2_1$ and a second meter-in valve $2_2$, respectively, the meter-in valves $2_1$, $2_2$ being two-way valves. The pressure oil which entered the first chamber $3_1$ and the second chamber $3_2$ is discharged into a tank 5 through a first meter-out valve $4_1$ and a second meter-out valve $4_2$, respectively, the meter-out valves $4_1$, $4_2$ being two-way valves. In case that both of the first meter-in valve $2_1$ and the second meter-out valve $4_2$ are opened, the pressure oil is supplied to the first chamber $3_1$ of the hydraulic equipment 3, while the pressure oil having entered the second chamber $3_2$ of the equipment 3 is discharged from the second chamber $3_2$ of the equipment 3 into the tank 5. In case that both of the second meter-in valve $2_2$ and the first meter-out valve $4_1$ are opened, the pressure oil is supplied to the second chamber $3_2$ of the hydraulic equipment 3, while the pressure oil having entered the first chamber $3_1$ of the hydraulic equipment 3 is discharged therefrom into the tank 5.

In addition, a pilot operated control valve system is known, in which each of the valves described above is constructed of a pilot operated valve and further comprises a first and a second pilot valve, which first pilot valve conducts directional controls of the first meter-in valve $2_1$ and the second meter-out valve $4_2$, and which second pilot valve conducts directional controls of the second meter-out valve $2_2$ and the first meter-out valve $4_1$.

On the other hand, in a power shovel, there are employed at least six hydraulic devices comprising: a boom derricking cylinder, an arm hydraulic cylinder, a bucket hydraulic cylinder, a swing hydraulic motor, a left-hand traveling hydraulic motor and a right-hand traveling hydraulic motor, to which hydraulic equipment the pressure oil is supplied through four valves. As a result, the power shovel requires at least 24 valves and 12 pilot valves in operation.

In the conventional pilot operated control valve system described above, it is required for a valve housing 6 of the control valve system to have in the interior thereof four valves comprising the first meter-in valve $2_1$, the second meter-in valve $2_2$, the first meter-out valve $4_1$ and the second meter-out valve $4_2$ and to form therein two pump ports $7_1$, $7_2$, two tank ports $8_1$, $8_2$, and four additional ports $9_1$, $9_2$, $9_3$, $9_4$, the first and the second pilot valve, and pilot passages communicating with these pilot valves. Consequently, in case that the above pilot operated control valve system is employed in the power shovel, it is required for the valve housing 6 of the control valve system of the power shovel to have 24 valves, 12 pilot valves, a plurality of the pump port passages, a plurality of the tank port passages, a plurality of the additional port passages and the pilot passages, which cause the valve housing 6 to be a large sized one. In addition, in the valve housing 6 of the pilot operated control valve system, it is very cumbersome to form each of the above port passages.

SUMMARY OF THE INVENTION

In view of such circumstances described above, the present invention was made. Consequently, it is an object of the present invention to provide a small-sized pilot operated control valve system requiring a minimum mounting space thereof, in which system a plurality of valves are employed to control hydraulic equipment, for example, such as a hydraulic cylinder wherein a required number of each of the above valves is reduced and there is no fear that the plurality of the valves interfere with each other in operation.

It is another object of the present invention to provide a small-sized pilot operated control valve system requiring a minimum mounting space thereof, in which system a plurality of control valves are employed to control each of a plurality of hydraulic devices and there is no fear that the plurality of control valves interfere with each other in operation.

According to a first embodiment of the present invention, the above objects of the present invention are accomplished by providing a pilot operated control valve system comprising a valve housing which is provided with a predetermined lateral width, a predetermined longitudinal width and a predetermined height, and assumes a substantially rectangular parallelepiped form; a first and a second pump port passage so formed in the valve housing as to have the same height, as to be parallelly spaced apart in parallel from each other in the longitudinal width direction of the valve housing and to horizontally extend in the lateral width direction of the valve housing; a tank port passage so formed in the valve housing as to be disposed in a lower portion of the valve housing, as to be disposed in a central position of the longitudinal width of the valve housing and as to horizontally extend in the lateral width direction of the valve housing; a pilot tank port passage so formed in the value housing as to be disposed in a central position of both of the height direction and the longitudinal width direction of the valve housing and as to horizontally extend in the lateral width direction of the valve housing; a first and a second port passage so formed in the valve housing as not to be aligned with each other in both the lateral width direction and the longitudinal width direction of the valve housing, as to extend vertically to open into an upper surface of the valve housing and as to communicate with a hydraulic equipment; a first meter-in valve so inserted into a first meter-in valve receiving bore as to selectively shut off the first pump port passage from the first port passage in operation, the first meter-in valve receiving bore being formed in an upper portion of the valve housing so as to open into a side surface of the valve housing perpendicular to the longitudinal width direction thereof, as to horizontally extend in the longitudinal width direction to penetrate the first pump port passage and as to communicate with the first port passage; a first meter-out valve so inserted into a first meter-out valve receiving bore as to selectively shut off the tank port passage from the second port passage, the first meter-out valve receiving bore being formed in a lower portion of the valve housing so as to open into the side surface of the valve housing perpendicular to the longitudinal width direction thereof, and as to horizontally extend in the longitudinal width direction to sequentially communicate with the second port passage and the tank port passage; a second meter-in valve so inserted into a second meter-in valve receiving bore as to selectively shut off the second pump port passage from the second port passage in operation, the second meter-in valve receiving bore being formed in the upper portion of the valve housing so as to open into the other side surface of the valve housing perpendicular to the longitudinal width direction thereof, and as to horizontally extend in the longitudinal width direction to penetrate the second pump port passage and as to communicate with the second port passage; a second meter-out valve so inserted into a second meter-out valve receiving bore as to selectively shut off the tank port passage from the first port passage, the second meter-out valve receiving bore being formed in the lower portion of the valve housing so as to open into the other side surface of the valve housing perpendicular to the longitudinal width direction thereof, and as to horizontally extend in the longitudinal width direction to sequentially communicate with the first port passage and the tank port passage; a first pilot valve so inserted into a first pilot valve receiving bore as to supply pilot pressure oil to both of the first meter-in valve and the first meter-out valve, the first pilot valve receiving bore being so formed in a central portion of the valve housing in height as to horizontally extend in the longitudinal direction of the valve housing to open into the side surface of the valve housing and as to communicate with the pilot tank port passage; and a second pilot valve so inserted into a second pilot valve receiving bore of the valve housing for supplying the pilot pressure oil to both of the second meter-in valve and the second meter-out valve, the second pilot valve receiving bore being so formed in a central position of the height of the valve housing as to open into the other side surface of the valve housing perpendicular to the longitudinal width direction of the valve housing, and as to horizontally extend in the longitudinal width direction of the valve housing and as to communicate with the pilot tank port passage.

According to a second embodiment of the present invention, the above objects of the present invention are accomplished by providing the pilot operated control valve system for controlling the hydraulic equipment of the first embodiment, wherein the pilot operated control valve system is constructed of a plurality of control valve units for controlling a plurality of hydraulic devices, the plurality of the control valve units being connected with each other in the lateral width direction of the valve housing of the control valve system.

The pilot operated control valve system of the present invention having the above first and the second embodiment has the following advantages:

In the pilot operated control valve system of the present invention, each of the first meter-in valve, the first meter-out valve, the first pilot valve, the second meter-in valve, the second meter-out valve and the second pilot valve is so formed in the valve housing of the pilot operated control valve system as to horizontally extend in the longitudinal width direction of the valve housing to open into one of the opposite side surfaces of the valve housing perpendicular to the longitudinal width direction thereof; and as not to be aligned with each other in the height direction and the lateral width direction of the valve housing. As a result, it is possible for the pilot operated control valve system of the present invention to mount each of the valves in the valve housing with a minimum mounting space thereof without any interference of the valves with each other.

Consequently, even when a plurality of valves are mounted in the valve housing of the pilot operated control valve system of the present invention, it is possible for the pilot operated control valve system of the present invention to realize a small-sized valve housing which leads to a small-sized pilot operated control valve system, because each of the plurality of the valves only requires a minimum mounting space thereof.

In addition, in the pilot operated control valve system of the present invention, since each of the first and the second pump port passage, tank port passage and the pilot tank port passage is so formed in the valve housing of the control valve system as not to be aligned with each other in either of the height direction and the longitudinal width direction of the valve housing and as to horizontally extend in the lateral width direction of the valve housing, it is possible to sequentially mount each of the first and the second meter-in valves, first and the second meter-out valves, and the first and the second pilot valves in the valve housing so as to be spaced apart from each other in the lateral width direction of the valve housing. As a result, it is not required for the valve housing of the pilot operated control valve system of the present invention to additionally form any of the first and the second pump port passages, tank port passage and pilot tank port passage therein. In other words, it is required for the valve housing of the pilot operated control valve system of the present invention to form only the required number of each of the first and the second port passages in the valve housing, which reduces machining steps of the valve housing in manufacturing.

The above objects, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Figure 1:
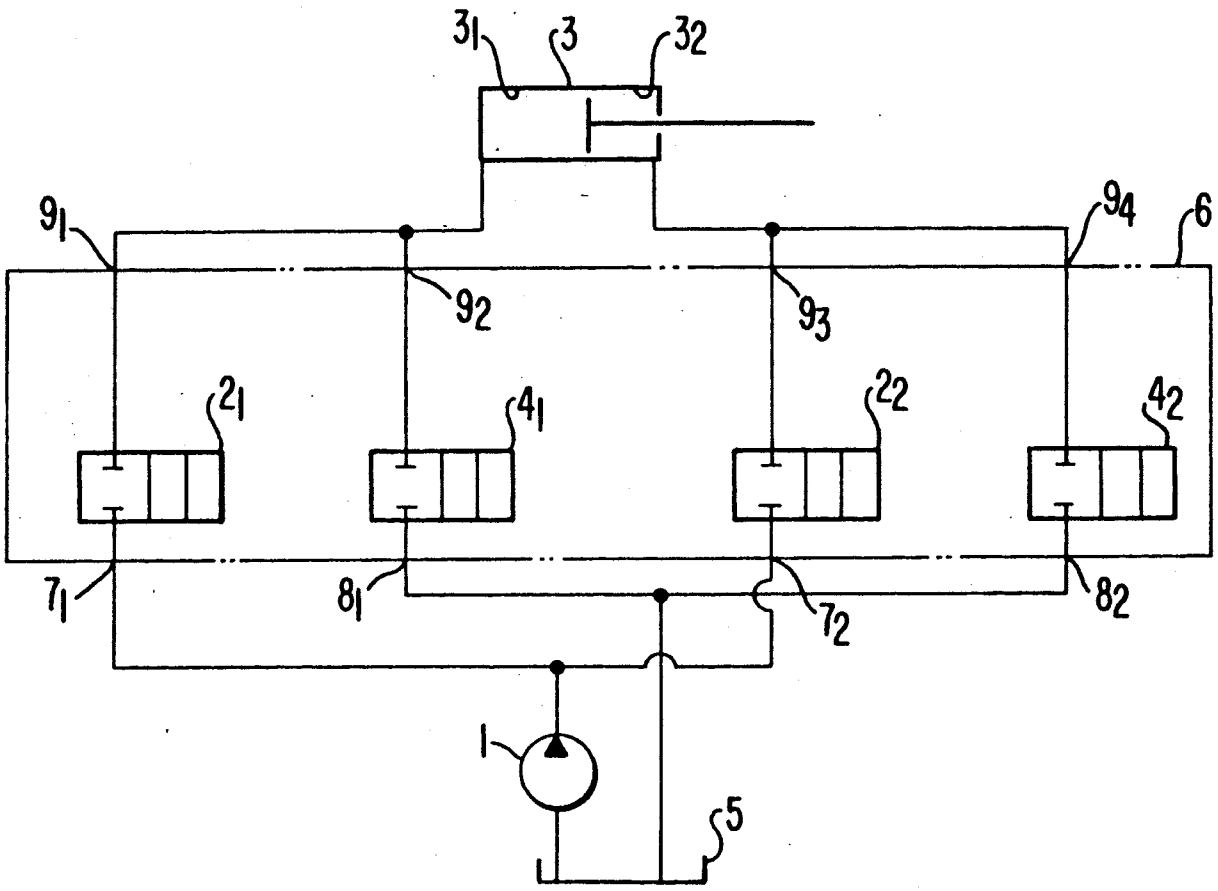
FIG. 1 (PRIOR ART)
FIG. 1 is a schematic circuit diagram illustrating an example of a conventional control valve system.

Hereinbelow, an embodiment of the present invention will be described in detail with reference to the accompanying drawings (FIGS. 2 to 12).

As shown in FIGS. 2 to 6, a valve housing 10 of a pilot operated control valve system of the present invention has a predetermined lateral width, a predetermined longitudinal width and a predetermined height, and assumes a rectangular parallelepiped form. In an upper portion of the valve housing 10 of the control valve system are formed a first pump port passage 11 and a second pump port passage 12 which communicate with a hydraulic pump (not shown), are parallel to each other and horizontally extend in the lateral width direction of the valve housing 10 to open into an end surface 10*a* of the valve housing 10, which end surface 10*a* is perpendicular to the lateral width direction of the valve housing 10. In addition, a tank port passage 13 is so formed in the valve housing 10 as to be disposed in a lower portion of the valve housing 10, as to be disposed in a central position of the longitudinal width of the valve housing 10, as to horizontally extend in the lateral width direction of the valve housing 10 and as to communicate with a drain tank (not shown) to open into the end surface 10*a* of the valve housing 10.

Further, a first port passage 14 and a second port passage 15 are so formed in the valve housing 10 as not to be aligned with each other in either of the lateral width direction or the longitudinal width direction of the valve housing 10, as to extend vertically to open into an upper surface 10*b* of the valve housing 10 and as to communicate with a first pressure chamber $16_1$ and a second pressure chamber $16_2$ of a hydraulic device 16, respectively. In addition, the first port passage 14 and the second port passage 15 are so formed in the valve housing 10 as not to interfere with any of the first pump port passage 11, second pump port passage 12 and the tank port passage 13.

Further, in the valve housing 10, a first meter-in valve receiving bore 17 and a first meter-out valve receiving bore 18 are so formed as to open into a side surface 10*c* of the valve housing 10 perpendicular to the longitudinal width direction of the valve housing 10, as not to be aligned with each other in the height direction and the lateral width direction of the valve housing 10, and as to horizontally extend in the longitudinal width direction of the valve housing 10. The first meter-in valve receiving bore 17 is so disposed in the upper portion of the valve housing 10 as to penetrate the first pump port passage 11, as to communicate with the first port passage 14 and as to receive a first meter-in valve 19 therein to selectively shut off the first pump port passage 11 from the first port passage 14. On the other hand, the first meter-out valve receiving bore 18 is so disposed in the lower portion of the valve housing 10 as to open into the tank port passage 13, as to communicate with the second port passage 15, and as to receive a first meter-out valve 20 therein to selectively shut off the tank port passage 13 from the second port passage 15.

Furthermore, in the valve housing 10, a second meter-in valve receiving bore $2_1$ and a second meter-out valve receiving bore $2_2$ are so formed as to open into the other side surface 10*d* of the valve housing 10 perpendicular to the longitudinal width direction of the valve housing 10, as not to be aligned with each other in either the height direction or the lateral width direction of the valve housing 10, and as to horizontally extend in the longitudinal width direction of the valve housing 10. The second meter-in valve receiving bore 21 is so disposed in the upper portion of the valve housing 10 as to be aligned with the first meter-out valve receiving bore 18 in the lateral width direction of the valve housing 10, as to penetrate the second pump port passage 12, as to communicate with the second port passage 15, and as to receive a second meter-in valve 23 therein to selectively shut off the second pump port passage 12 from the second port passage 15. On the other hand, the second meter-out valve receiving bore 22 is so disposed in the lower portion of the valve housing 10 as to be aligned with the first meter-in valve receiving bore 17 in the lateral width direction of the valve housing 10, as to open into the tank port passage 13, as to communicate with the first port passage 14 and as to receive a second meter-out valve 24 therein to selectively shut off the tank port passage 13 from the first port passage 14.

Figure 2:
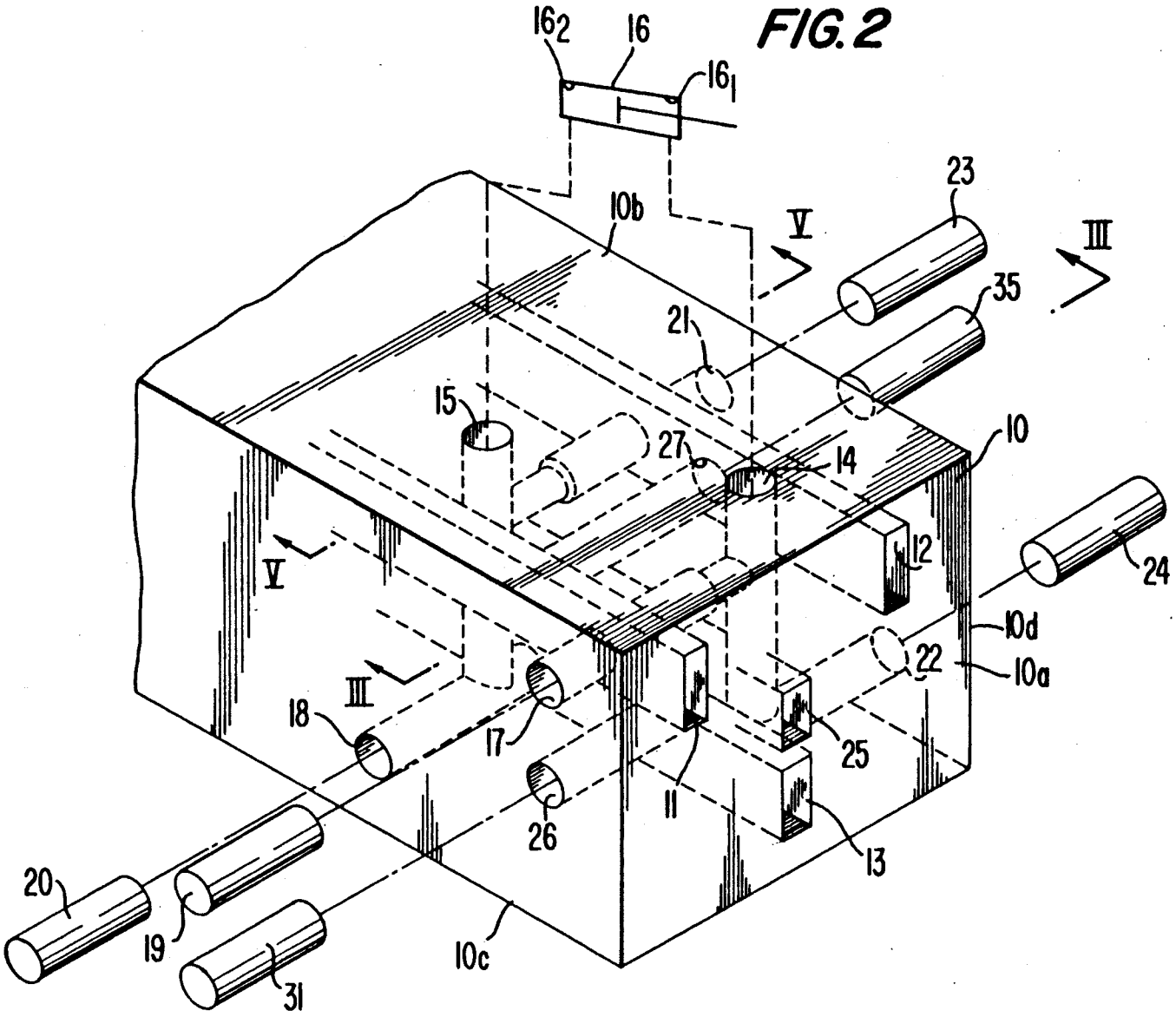
FIG. 2 is a perspective view of a valve housing of a pilot operated control valve system of an embodiment of the present invention.

Furthermore, as shown in FIG. 2, in central positions of both of the height and the longitudinal width of the valve housing 10 is disposed a pilot tank port passage 25 which extends horizontally in the lateral width direction of the valve housing 10 to open into the end surface 10*a* of the valve housing 10. Namely, the pilot tank port passage 25 is disposed in a position above the tank port passage 13 and extends parallel thereto.

In the valve housing 10 is further formed a first pilot valve receiving bore 26 which is so arranged: as to be disposed in a position under the first meter-in valve receiving bore 17; as to be similar to the pilot tank port passage 25 in height and to open into a side surface 10*c* of the valve housing 10, the side surface 10*c* being perpendicular to the longitudinal width direction of the valve housing 10, as to horizontally extend in the longitudinal width direction of the valve housing 10; and as not to be aligned with both of the first pilot valve receiving bore 26 and the second port passage 15 in the lateral width direction of the valve housing 10.

In addition, a second pilot valve receiving bore 27 is so formed in the valve housing 10: as to be disposed in a lower portion of the valve housing 10; as to be similar to the pilot tank port passage 25 in height; as to open into the other side surface 10*d* of the valve housing 10; as to horizontally extend in the longitudinal width direction of the valve housing 10, and as not to be aligned with both of the second pilot valve receiving bore 27 and the first port passage 14 in the lateral width direction of the valve housing 10.

Figure 3:
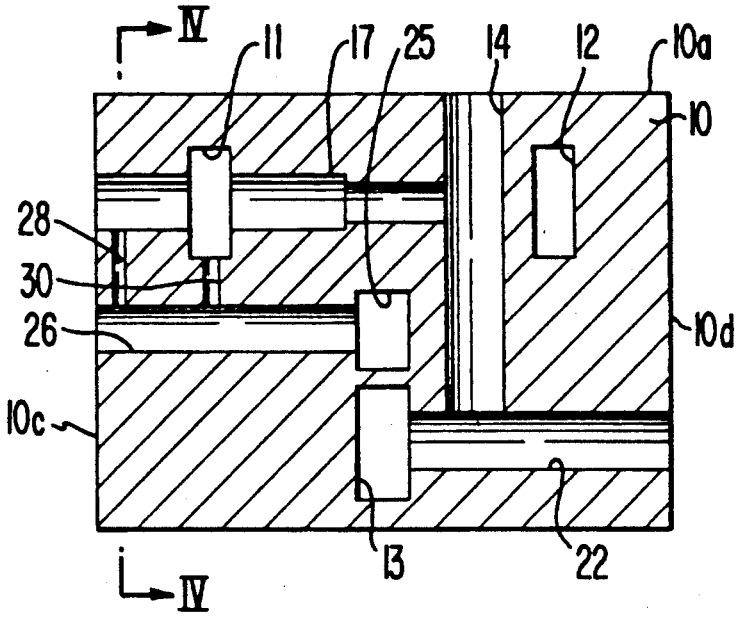
FIG. 3 is a cross-sectional view of the valve housing of the pilot operated control valve system- of the present invention, taken along the line III—III of FIG. 2.
Figure 4:
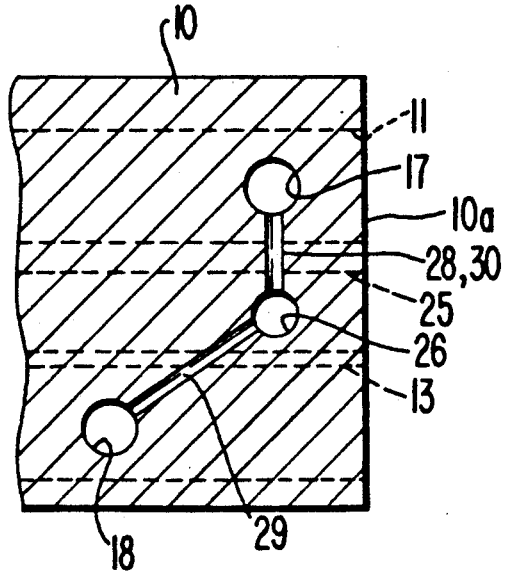
FIG. 4 is a cross-sectional view of the valve housing of the pilot operated control valve system of the present invention, taken along the line IV—IV of FIG. 3.
Figure 5:
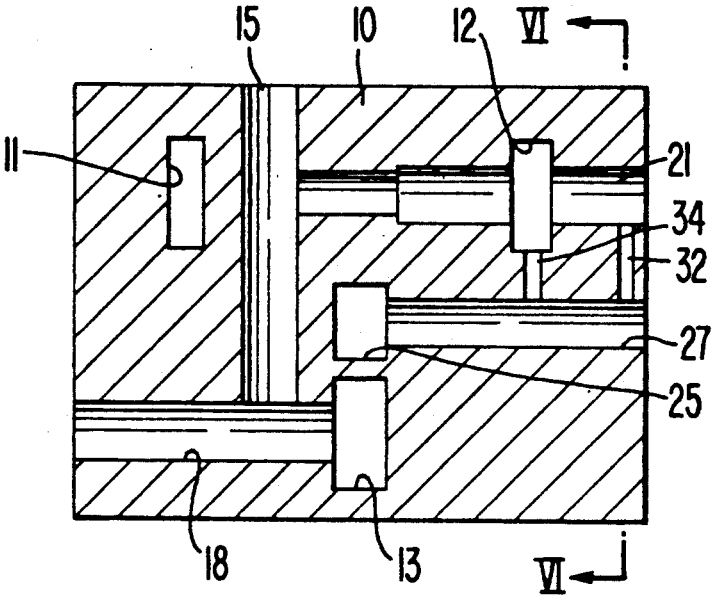
FIG. 5 is a cross-sectional view of the valve housing of the pilot operated control valve system of the present invention, taken along the line V—V of FIG. 2.
Figure 6:
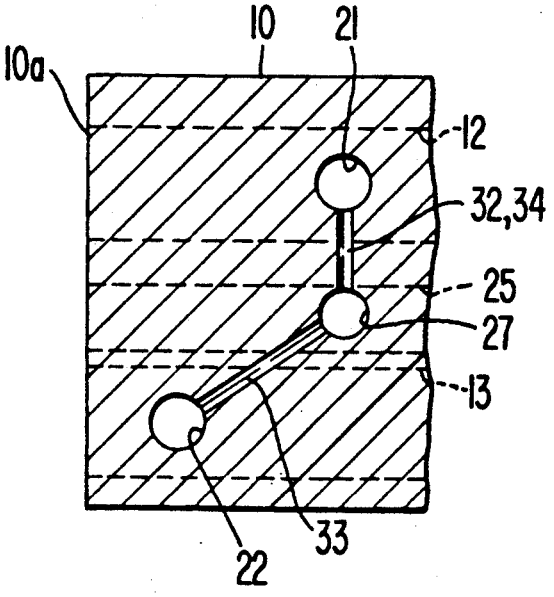
FIG. 6 is a cross-sectional view of the valve housing of the pilot operated control valve system of the present invention, taken along the line VI—VI of FIG. 5.

As shown in FIGS. 3 and 4, the first pilot valve receiving bore 26 communicates with the pilot tank port passage 25 and further communicates with the first meter-in valve receiving bore 17, the first meter-out valve receiving bore 18 and the first pump port passage 11 through a first oil hole 28, a second oil hole 29 and a third oil hole 30. A first pilot valve is inserted into the first pilot valve receiving bore 26 of the valve housing 10 as shown in FIG. 2. On the other hand, as shown in FIGS. 5 and 6, the second pilot valve receiving bore 27 communicates with the pilot tank port passage 25 and further communicates with the second meter-in valve receiving bore 21, the second meter-out valve receiving bore 22 and the second pump port passage 12 through a first oil hole 32, a second oil hole 33 and a third oil hole 34. A second pilot valve 35 is inserted into the second pilot valve receiving bore 27 of the valve housing 10.

Figure 7:
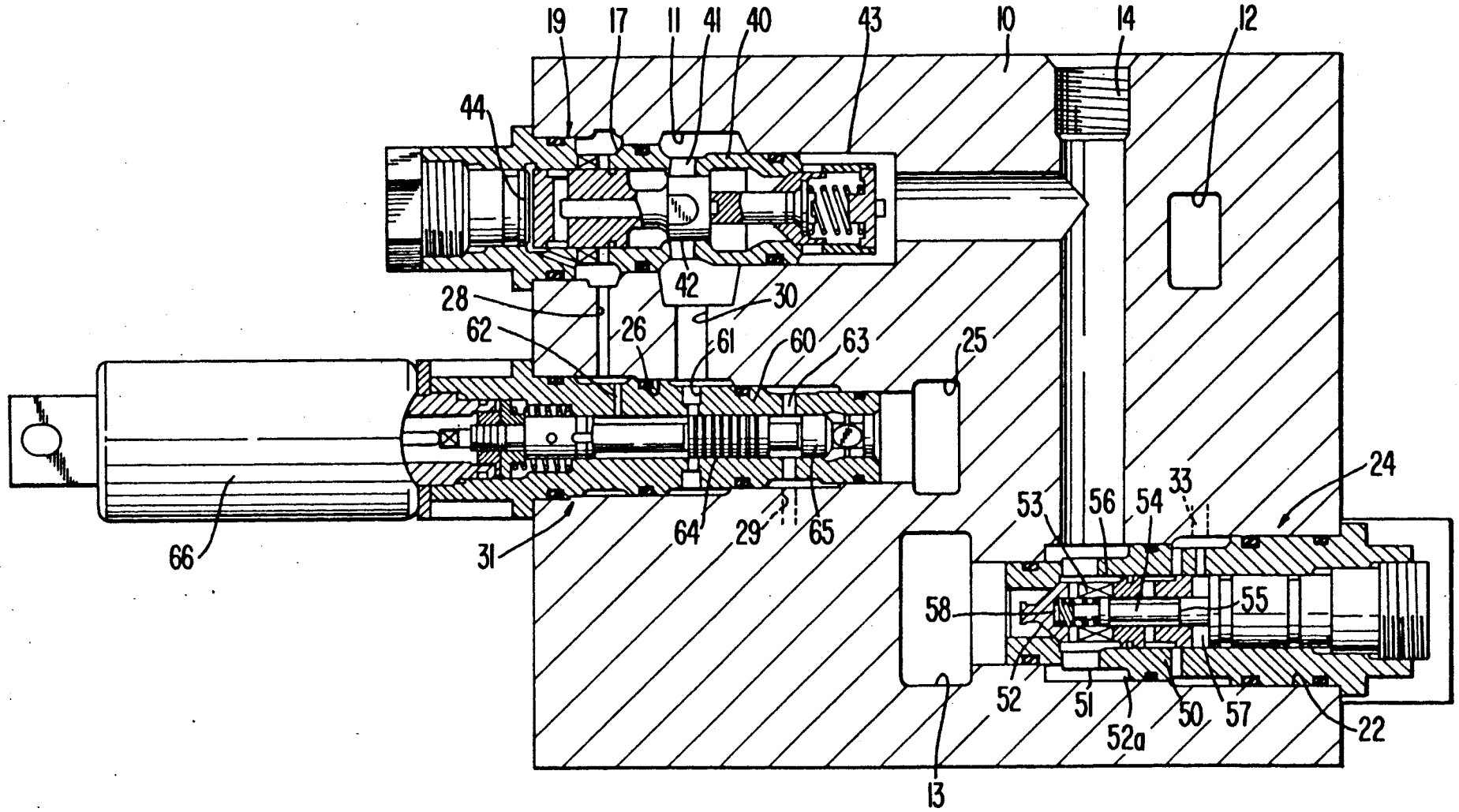
FIGS. 7 and 8 are cross-sectional views of the valve housing of the pilot operated control valve system of the present invention, illustrating the meter-in valves, meter-out valves and the pilot valves in construction.
Figure 8:
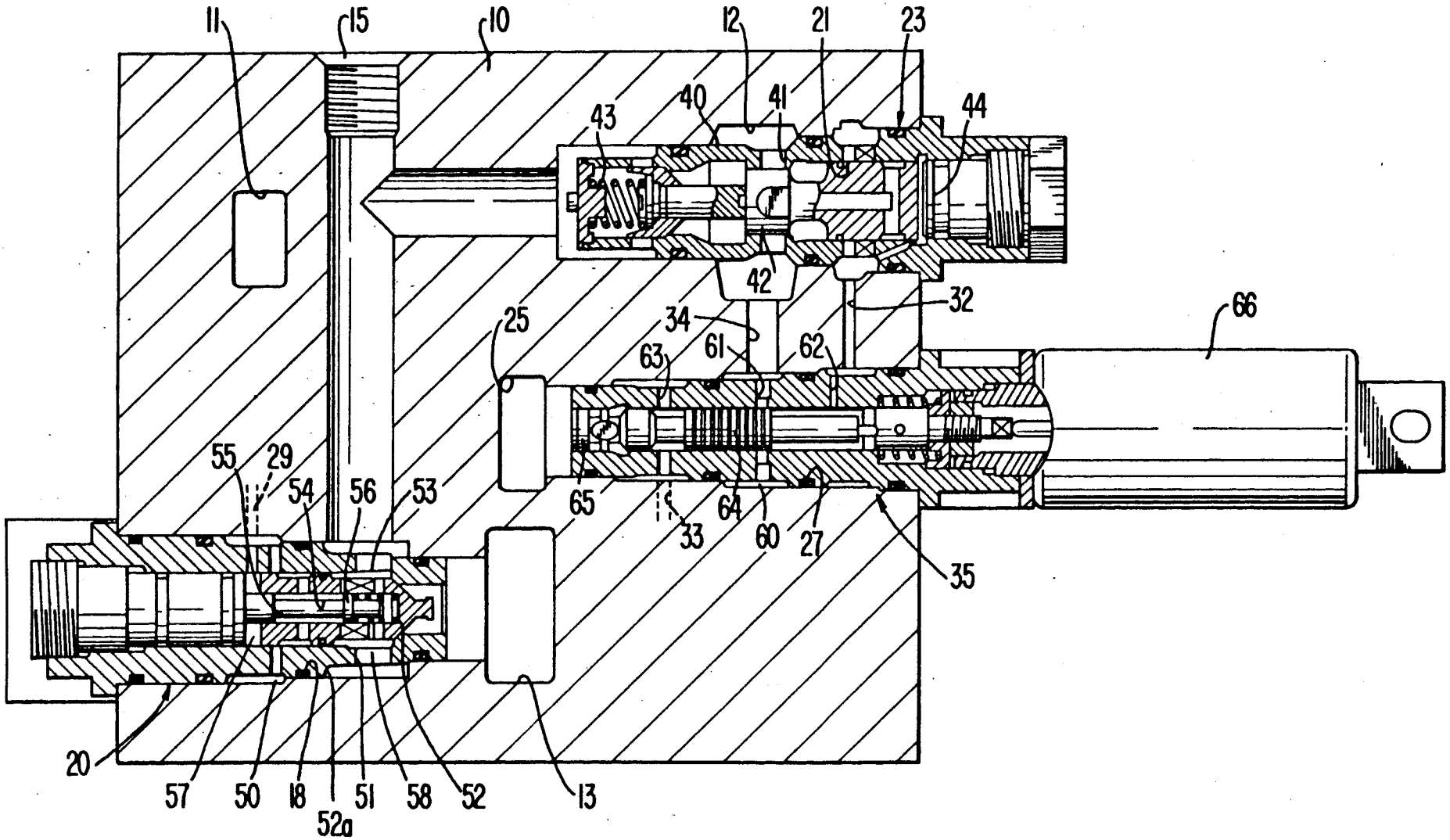

As shown in FIGS. 7 and 8, each of the first meter-in valve 19 and the second meter-in valve 21 is so constructed that: an inlet port 41 is formed in a sleeve-like element 40; a spool 42 is inserted into the sleeve-like element 40 to selectively shut off and open the inlet port 41, the spool being so positioned as to normally shut off the inlet port 41 under the influence of a resilient force exerted by a spring 43 and as to open the inlet port 41 when subjected to a predetermined pilot pressure developed in a pressure chamber 44.

As shown in FIGS. 7 and 8, each of the first meter-out valve 20 and the second meter-out valve 24 is so constructed that: an inlet port 51 is formed in a sleeve-like element 50; a poppet 52 for selectively shut off the inlet port 51 from the tank port passage 13 is inserted into the sleeve-like element 50, the inlet port 51 communicates with a back-pressure chamber 57 through a variable aperture 56 which is constructed of a slit groove 53 and a spool 55 having been inserted into an axial bore 54 of the sleeve-like element 50, to develop a pressure difference across the variable aperture 56; and a spring 58 is interposed between the spool 55 and a bottom portion of the axial bore 54 to normally bring the poppet 52 to its shut-off condition.

As shown in FIGS. 7 and 8, in each of sleeve-like elements 60 of the first pilot valve 31 and the second pilot valve 35 are formed: an inlet port 61, an outlet port 62 and a drain port 63. A spool 64 for selectively shutting off the inlet port 61 from the outlet port 62 is integrally formed with a poppet 65 for selectively shutting off the drain port 63 from the pilot tank port passage 25, while inserted into the sleeve-like element 60. Each of the spool 64 and the poppet 65 is operated by means of a solenoid 66. The inlet port 61 communicates with the first pump port passage 11 and the second pump port passage 12 through the third oil hole 30 and 34, respectively. On the other hand, the outlet port 62 communicates with the pressure chamber 44 of each of the first meter-in valve 19 and the second meter-in valve 23 through the first oil holes 28 and 32, while the drain port 63 communicates with the back-pressure chamber 57 of each of the first meter-out valve 20 and the second meter-out valve 24 through the second oil holes 29 and 33.

Namely, the pilot operated control valve system of the present invention has the above construction so that, when the inlet port 61 communicates with the outlet port 62 by displacing the spool 64 and the poppet 65 by means of a solenoid 66 of each of the first pilot valve 31 and the second pilot valve 35 while the drain port 63 communicates with the pilot tank port passage 25, a pressure oil discharged from the tank port passage 13 is supplied to the pressure chamber 44 of the first meter-in valve 19 or the second meter-in valve 23 to move the spool 42 to its communication position. At the same time, since the back-pressure chamber 57 of the first meter-out valve 20 of the second meter-out valve 24 communicates with the pilot tank port passage 25 to bring the poppet 52 to its communication position, the pressure oil discharged from first pump port passage 11 or the second pump port passage 12 is supplied to the first port passage 14 or the second port passage 15 from which the pressure oil is further supplied to the tank port passage 13.

Figure 9:
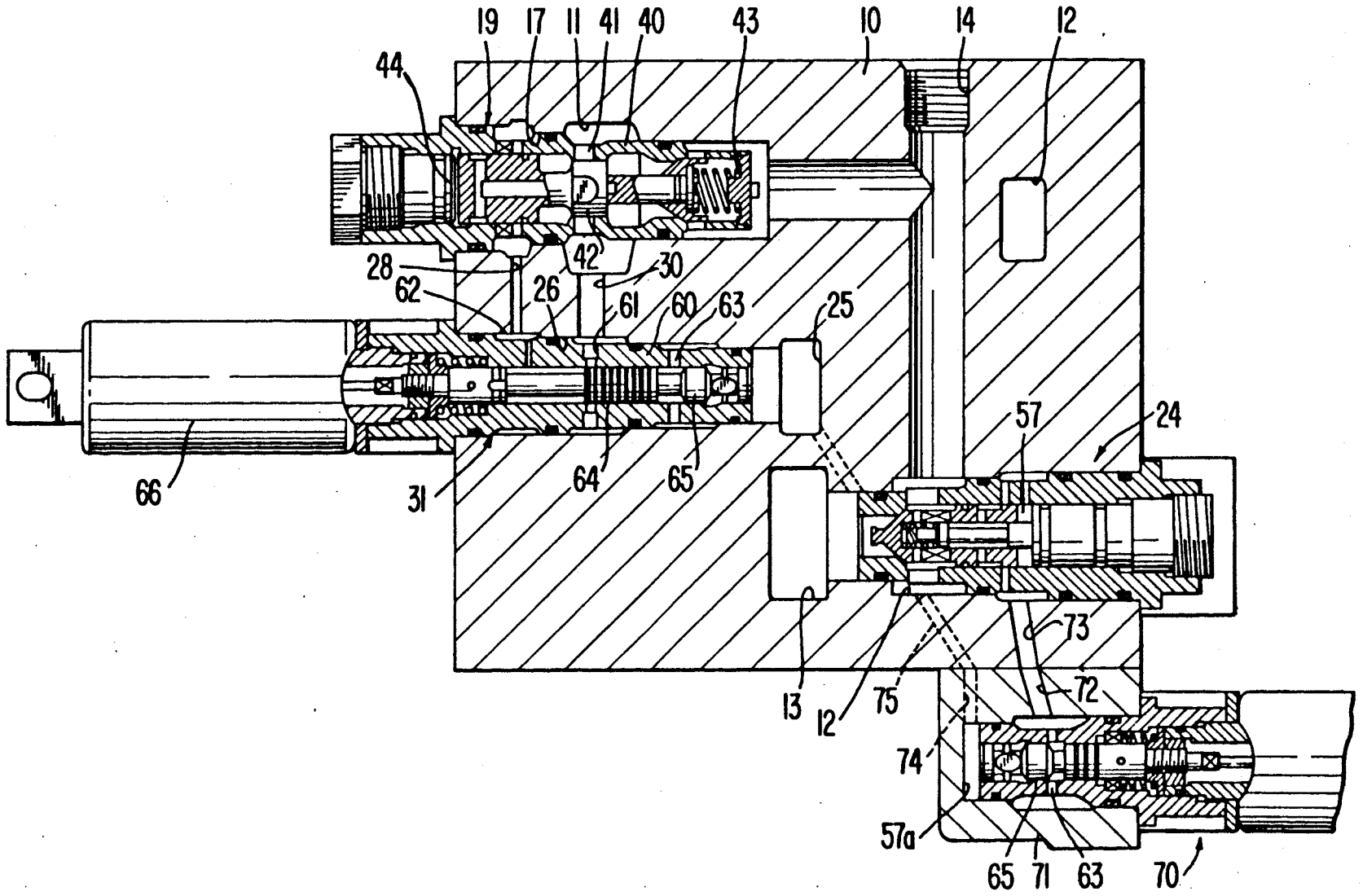
FIGS. 9 and 10 are cross-sectional views of the valve housing of the pilot operated control valve system of the present invention, illustrating the meter-in valves, meter-out valves and the pilot valves in construction for separately controlling the second meter-in valve and the second meter-out valve.
Figure 10:
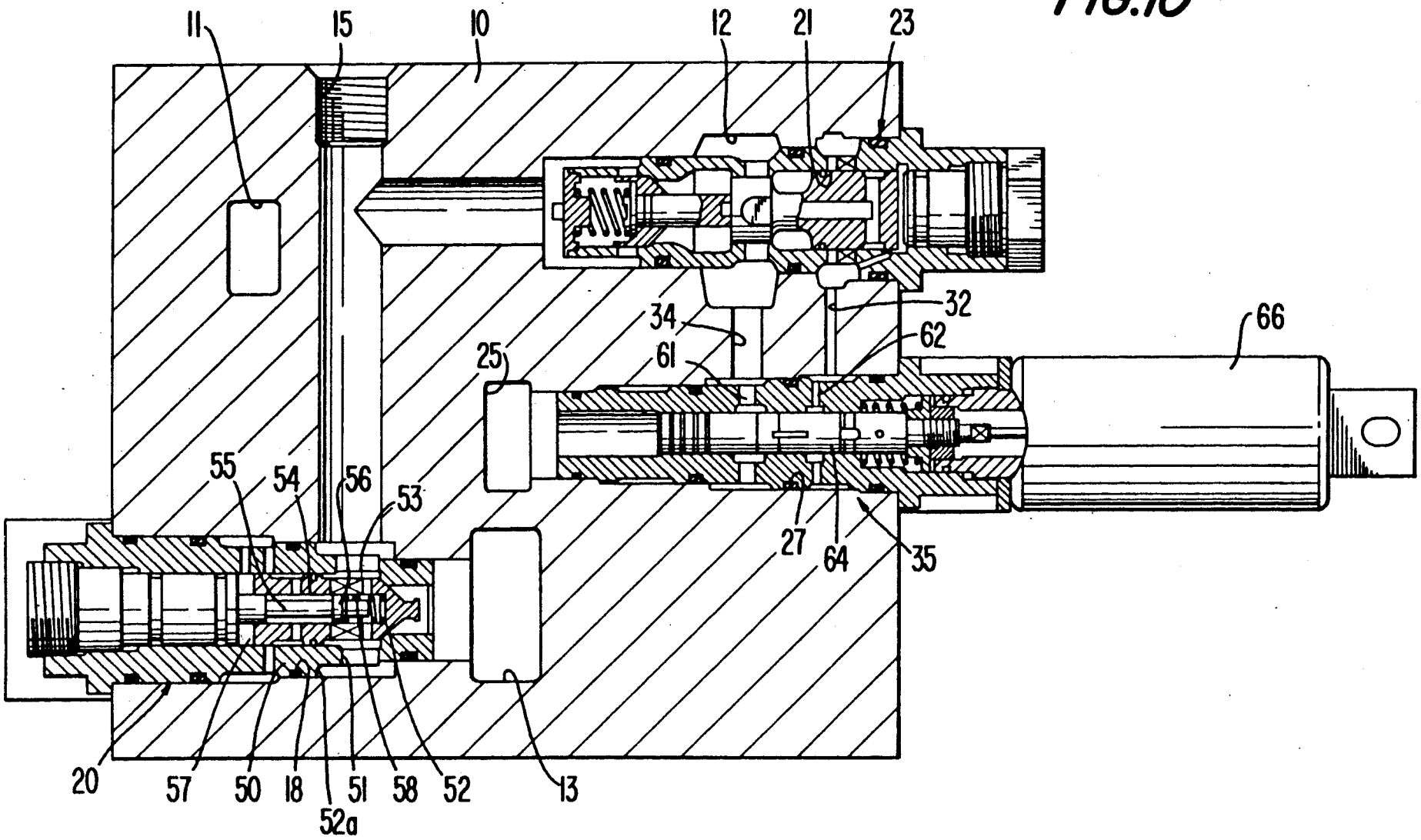

Since the pilot operated control valve system of the present invention has the above construction, in order to separately control the second meter-in valve 23 and the second meter-out valve 24, it is required that: as shown in FIG. 9, an auxiliary valve housing 71 is mounted on the valve housing 10 in a position under the second meter-out valve 24 provided in a lower portion of the valve housing 10 adjacent to the other side surface thereof perpendicular to the longitudinal width direction of the valve housing 10. The auxiliary valve housing 71 is provided with an auxiliary second pilot valve 70 which is similar to the second pilot valve 35 in shape. The drain port 63 of the auxiliary second pilot valve 70 communicates with the back-pressure chamber 57 of the second meter-out valve 24 through oil holes 72, 73. A pressure chamber 57*a* adjacent to an outlet side portion of the poppet 65 communicates with the pilot tank port passage 25 through oil holes 74, 75. As shown in FIG. 10, the second pilot valve 35 may have a construction provided with the spool 64 only, which spool 64 selectively shuts off the inlet port 61 from the outlet port 62.

In the pilot operated control valve system of the present invention having the above construction, it is possible to control the second meter-in valve 21 by means of the second pilot valve 35 and to control the second meter-out valve 24 by means of the auxiliary second pilot valve 70.

Incidentally, the same modification as described above is applied to the pilot operated control valve system of the present invention to separately control the first meter-in valve 19 and the first meter-out valve 20.

Figure 11:
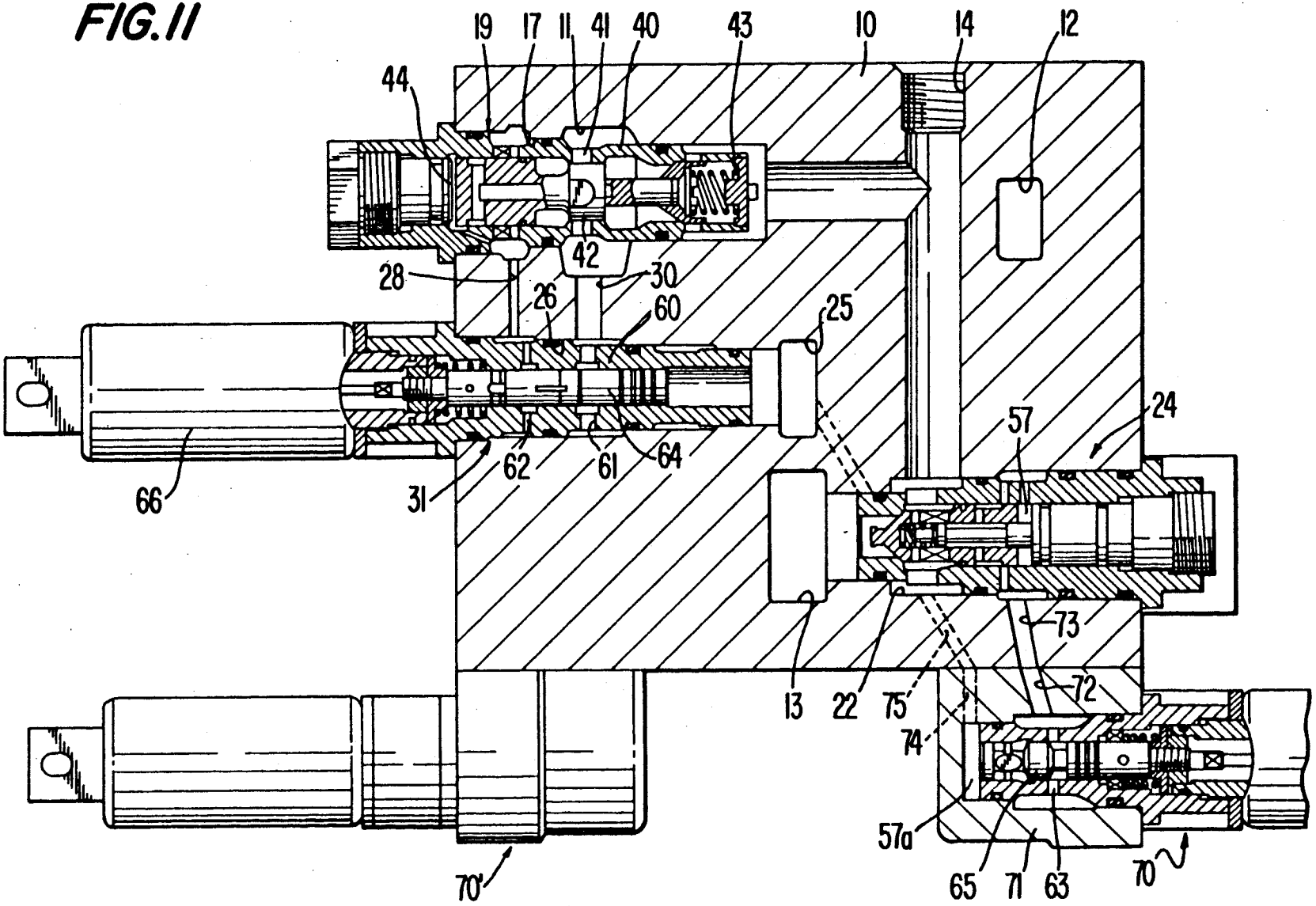
FIGS. 11 and 12 are cross-sectional views of the valve housing of the pilot operated control valve system of the present invention, illustrating the meter-in valves, meter-out valves and the pilot valves in construction for separately controlling a pair of the first meter-in valve and the first meter-out valve and a pair of the second meter-in valve and the second meter-out valve.
Figure 12:
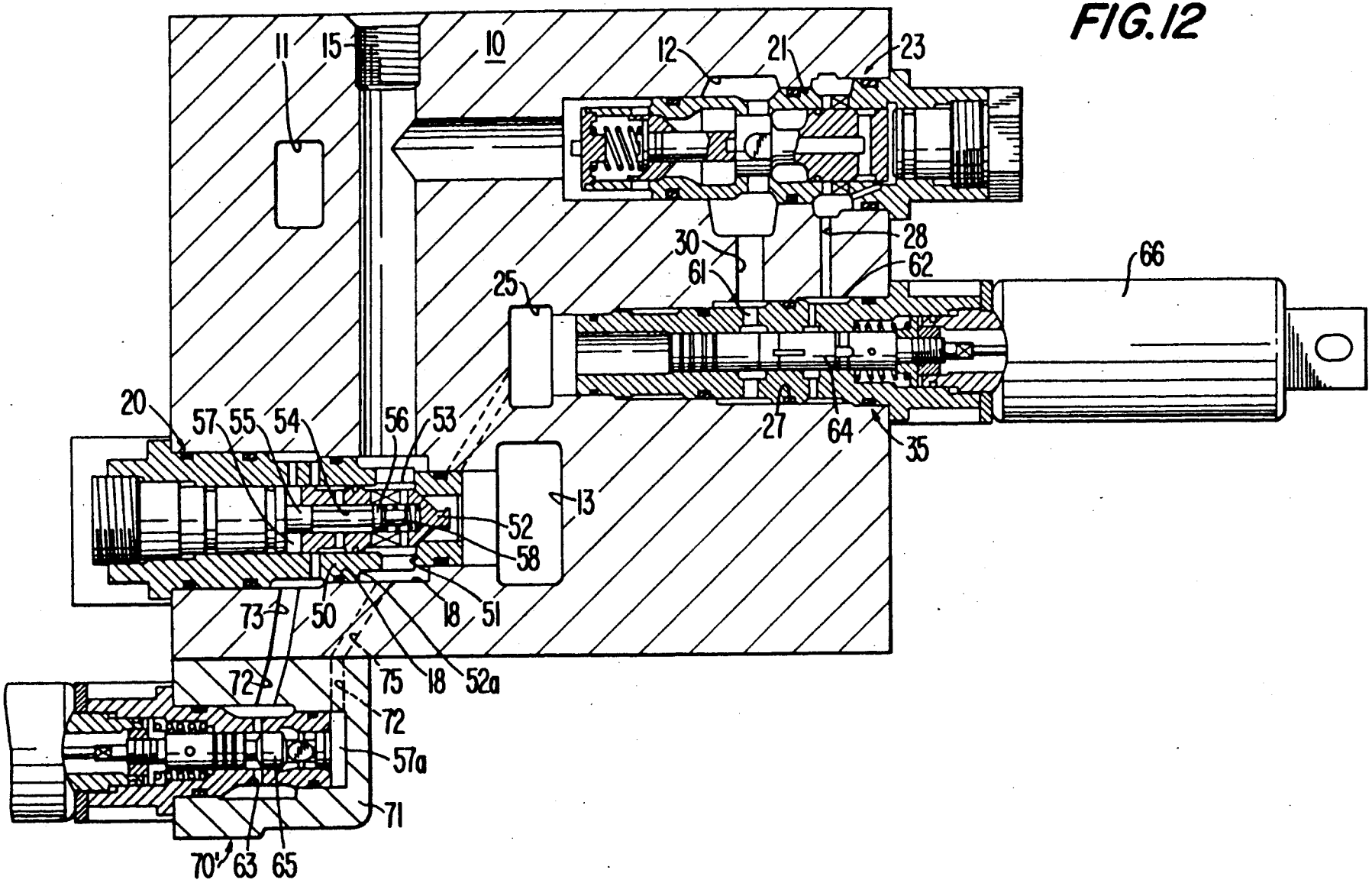

In addition, in order to separately control the first meter-in valve 19, first meter-out valve 20, second meter-in valve 23 and the second meter-out valve 24: as shown in FIGS. 11 and 12, a first auxiliary pilot valve 70′ having the same construction as that of the second auxiliary pilot valve 70 is mounted in the valve housing 10 in a position under the first meter-out valve 20 mounted in the valve housing 10 to control the first meter-out valve 20 by means of the first auxiliary pilot valve 70′; and the first pilot valve $3_1$ has a construction provided with a spool 64 only, which spool 64 selectively shuts off the inlet port 61 from the outlet port 62 to control the first meter-in valve 19 only.

We claim:

1. A pilot operated control valve system comprising:

a valve housing which is provided with a predetermined lateral width, a predetermined longitudinal width and a predetermined height, and assumes a substantially rectangular parallelepiped form;

a first and a second pump port passage so formed in said valve housing as to have the same height, as to be spaced apart in parallel from each other in said longitudinal width direction of said valve housing and as to horizontally extend in said lateral width direction of said valve housing;

a tank port passage so formed in said valve housing as to be disposed in a lower portion of said valve housing, as to be disposed in a central portion of said longitudinal width of said valve housing, and as to horizontally extend in said lateral width direction of said valve housing;

a pilot tank port passage so formed in said valve housing as to be disposed in a central position of both of said height direction and said longitudinal width direction of said valve housing and as to horizontally extend in said lateral width direction of said valve housing;

a first and a second port passage so formed in said valve housing as not to be aligned with each other in either said lateral width direction or said longitudinal width direction of said valve housing, as to extend vertically to open into an upper surface of said valve housing and as to communicate with hydraulic equipment;

a first meter-in valve so inserted into a first meter-in valve receiving bore as to selectively shut off said first pump port passage from said first port passage in operation, said first meter-in valve receiving bore being formed in an upper portion of said valve housing so as to open into a side surface of said valve housing perpendicular to said longitudinal width direction thereof, as to horizontally extend in said longitudinal width direction to penetrate said first pump port passage, and as to communicate with said first port passage;

a first meter-out valve so inserted into a first meter-out valve receiving bore as to selectively shut off said tank port passage from said second port passage, said first meter-out valve receiving bore being formed in a lower portion of said valve housing so as to open into said side surface of said valve housing perpendicular to said longitudinal width direction thereof, as to horizontally extend in said longitudinal width direction to sequentially communicate with said second port passage and said tank port passage;

a second meter-in valve so inserted into a second meter-in valve receiving bore as to selectively shut off said second pump port passage from said second port passage in operation, said second meter-in valve receiving bore being formed in said upper portion of said valve housing so as to open into the other side surface of said valve housing perpendicular to said longitudinal width direction thereof, as to horizontally extend in said longitudinal width direction to penetrate said second pump port passage, and as to communicate with said second port passage;

a second meter-out valve so inserted into a second meter-out valve receiving bore as to selectively shut off said tank port passage from said first port passage, said second meter-out valve receiving bore being formed in said lower portion of said valve housing so as to open into the other side surface of said valve housing perpendicular to said longitudinal width direction thereof, as to horizontally extend in said longitudinal width direction to sequentially communicate with said first port passage and said tank port passage;

a first pilot valve so inserted into a first pilot valve receiving bore as to supply pilot pressure oil to at least one of said first meter-in valve and said first meter-out valve, said first pilot valve receiving bore being so formed in a central portion of said valve housing in height as to horizontally extend in said longitudinal direction of said valve housing to open into said side surface of said valve housing and as to communicate with said pilot tank port passage; and a second pilot valve so inserted into a second pilot valve receiving bore of said valve housing for supplying said pilot pressure oil to at least one of said second meter-in valve and said second meter-out valves, said second pilot valve receiving bore being so formed in a central position of said height of said valve housing as to open into the other side surface of said valve housing perpendicular to said longitudinal width direction of said valve housing, as to horizontally extend in said longitudinal width direction of said valve housing, and as to communicate with said pilot tank port passage.

2. The pilot operated control valve system as set forth in claim 1, wherein in order to separately control said first meter-in valve and said first meter-out valve from each other, said first pilot valve is dedicated to said first meter-in valve in operation; and said pilot operated control valve system further comprises a first auxiliary pilot valve dedicated to said first meter-in valve in operation.

3. The pilot operated control valve system as set forth in claim 1, wherein in order to separately control said second meter-in valve and said second meter-out valve from each other, said second pilot valve is dedicated to said second meter-in valve; and said pilot operated control valve system further comprises a second auxiliary pilot valve dedicated to said second meter-out valve.

4. The pilot operated control valve system as set forth in claim 1, wherein, said pilot operated control valve system is constructed of a plurality of control valve units for controlling a plurality of hydraulic equipment, said plurality of said control valve units being connected with each other in said lateral width direction of said valve housing of said pilot operated control valve system.

* * * * *